United States Patent [19]

Caple

[11] Patent Number: 4,748,373

[45] Date of Patent: May 31, 1988

[54] FLAT CATHODE RAY DISPLAY TUBE WITH BEAM GENERATOR SUBASSEMBLY

[75] Inventor: Adrian Caple, Purley, England

[73] Assignee: U.S. Philips Corporation, New York, N.Y.

[21] Appl. No.: 904,439

[22] Filed: Sep. 8, 1986

[30] Foreign Application Priority Data

Sep. 11, 1985 [GB] United Kingdom ..... 8522543

[51] Int. Cl.[4] ..... H01J 29/86

[52] U.S. Cl. ..... 313/422; 313/103 R; 313/103 CM; 313/105 R; 313/105 CM; 313/106; 313/107; 313/481; 313/482; 313/560; 313/634

[58] Field of Search ..... 313/422, 481, 560, 634, 313/482, 106, 107, 103, 103 CM, 105, 105 CM

[56] References Cited

U.S. PATENT DOCUMENTS

| | | | |
|---|---|---|---|
| 2,795,729 | 6/1957 | Gabor | 313/422 |
| 2,864,970 | 12/1958 | Aiken | 313/422 |
| 2,885,595 | 4/1959 | Gabor | 313/422 |
| 2,926,255 | 2/1960 | Gabor et al. | 313/422 |
| 2,926,274 | 2/1960 | Gabor | 313/422 |
| 2,982,875 | 5/1961 | Gabor | 313/422 |
| 3,171,056 | 2/1965 | Gabor | 313/422 |
| 4,209,727 | 6/1980 | Hausheer | 313/482 |
| 4,451,756 | 5/1984 | Sato et al. | 313/422 |
| 4,564,785 | 1/1986 | Sato et al. | 313/422 |
| 4,621,215 | 11/1986 | Tanaka | 313/422 |

FOREIGN PATENT DOCUMENTS

| | | | |
|---|---|---|---|
| 2101396 | 1/1983 | United Kingdom | 313/422 |

*Primary Examiner*—David K. Moore
*Assistant Examiner*—Michael J. Nickerson
*Attorney, Agent, or Firm*—John C. Fox

[57] ABSTRACT

A flat cathode ray display tube has an envelope divided into front and rear portions by a partition carrying frame deflection electrodes with an electron gun (30) and line scanning deflector positioned in the rear portion, the electron beam being directed initially parallel to a flat faceplate of the envelope, turned through 180° by a reversing lens into the front portion and then deflected by electrodes towards a screen on the faceplate. In addition to the electrodes, other components are also mounted on the partition forming a sub-assembly whereby correct mutual positioning is ensured and assembly facilitated. A spacing structure accurately spaces the sub-assembly from the faceplate and supports also an electron multiplier for beam current amplication.

10 Claims, 4 Drawing Sheets

FLAT CATHODE RAY DISPLAY TUBE WITH BEAM GENERATOR SUBASSEMBLY

BACKGROUND OF THE INVENTION

This invention relates to a flat cathode ray display tube comprising an envelope including a faceplate on which a screen is provided, a partition within the envelope and arranged substantially parallel to, and spaced from, the faceplate, the partition dividing the envelope into a front portion adjoining the faceplate and a rear portion which communicates with the front portion at one end of the envelope, means in the rear portion for producing an electron beam which is directed towards said one end, means in the rear portion for deflecting the electron beam in one dimension, a reversing lens at said one end for deflecting the electron beam into the front portion, and a deflection electrode arrangement carried by the partition and facing the faceplate for deflecting the electron beam in the front portion towards the screen.

A display tube of this kind is described in published British Patent Application No. 2101396A corresponding to U.S. patent application Ser. No. 830,388, filed Feb. 14, 1986 (PHB32794). In this tube the means in the rear portion for deflecting the electron beam in one dimension deflects the beam in a plane substantially parallel to the faceplate in order to effect line scanning, the aforementioned deflection electrode arrangement in the front portion being arranged to deflect the beam in another dimension to achieve frame scanning. Disposed between this deflection electrode arrangement and the screen there is a channel plate electron multiplier which extends parallel to, and is spaced from, the screen. The beam is deflected onto the input side of the multiplier and undergoes electron multiplication within the multiplier, the current multiplied beam emanating from the output of the multiplier being accelerated towards the screen by means of an acceleration electrode on the screen.

In a realised embodiment of this tube, the means for producing the electron beam, namely an electron gun, and the means in the rear portion for deflecting the electron beam are carried on the rear wall of the envelope of the tube which extends opposite the faceplate. The reversing lens comprises a number of parts, a first and second of which are similarly carried on the rear wall of the housing. A further part is carried by the partition, which is in the form of a glass plate. The electrodes of the deflection electrode arrangement are deposited on the surface of this plate facing the screen. The electron multiplier is supported adjacent the screen by a separate member.

It has been found that difficulties can be experienced in manufacturing these tubes repeatedly in a sufficiently dependable manner so far as operational performance is concerned. Moreover the form of construction used does not lend itself to mass production.

It is important to the proper operation of the kind of flat tube described in the opening paragraph that the internal operative components, i.e. the electron beam producing means, deflection means, reversing lens, deflection electrode arrangement, and screen, be positioned and located accurately with respect to one another. It is believed that the problems encountered with the aforementioned tubes may be attributable to the manner of construction employed, with unreliable and insufficient accuracy being achieved in the location of the components with respect to one another.

It is an object of the present invention to provide an improved form of construction of a flat cathode ray display tube of the kind described in the opening paragraph, which lends itself to mass production and as a result of which desired operational performance of the tube can be repeatedly achieved.

SUMMARY OF THE INVENTION

According to the present invention, there is provided a flat cathode ray display tube comprising an envelope including a faceplate on which a screen is provided, a partition within the envelope and arranged substantially parallel to, and spaced from, the faceplate, the partition dividing the envelope into a front portion adjoining the faceplate and a rear portion which communicates with the front portion at one end of the envelope, means in the rear portion for producing an electron beam which is directed towards said one end, means in the rear portion for deflecting the electron beam in one dimension, a reversing lens at said one end for deflecting the electron beam into the front portion, and a deflection electrode arrangement carried by the partition and facing the faceplate for deflecting the electron beam in the front portion towards the screen, wherein the means for producing an electron beam and the means for deflecting the electron beam in one dimension in the rear portion are mounted on the partition so as to form together with the deflection electrode arrangement carried thereby a sub-assembly, said sub-assembly being mounted within the envelope in a predetermined position and respect to the faceplate.

In this way, the means for producing an electron beam, the deflecting means and the deflection electrode arrangement are combined in one unit which can be fabricated and checked easily prior to being installed in the envelope during final assembly of the tube. As the components comprising the sub-assembly are all carried on this single unit, the accuracy of their relative positioning and location with respect to the partition, which serves as a reference, and thus with respect to one another, can be controlled readily and checked before being used in the tube to ensure reliability. This contrasts with the arrangement used previously where the relative positions of the components are determined only upon final assembly of the tube so that any error existing would be difficult to measure and correct.

Preferably, the reversing lens is also mounted on the partition, thus similarly enabling the positioning of the reversing lens relative to the other components of the sub-assembly to be accurately determined and checked, prior to assembly in the tube. Since these components constitute major operational components of the tube, the provision of this sub-assembly means that sufficient accuracy of their relative positioning, using the partition as a reference, can be reliably obtained during manufacture and mass production of the tube is greatly facilitated, the percentage of faulty tubes produced being considerably reduced.

In a preferred embodiment of the invention, the partition of the sub-assembly is maintained in predetermined spatial relationship with the faceplate by a spacing structure intermediate and engaging with the faceplate and the partition. The partition may, for example, be urged against the spacing structure by resilient means acting between the partition and a rear wall of the envelope. The spacing structure and the faceplate have cooperating means, for example lugs and recesses respectively, for locating the spacing structure laterally of the faceplate. The spacing structure extends around the screen and defines an opening overlying the screen and the deflection electrode arrangement of the sub-assembly. The tube of this preferred embodiment further includes a channel plate electron multiplier which extends over this opening and is supported around its periphery by parts of the spacing structure substantially parallel to, and spaced from, both the faceplate and the partition, and which has an input side facing the deflection electrode arrangement for receiving the electron beam and an output side facing the faceplate. In this way, the position of the electron multiplier of accurately determined with respect to the screen, and also with respect to the sub-assembly.

In order to ensure correct lateral positioning of the sub-assembly within the envelope, the partition preferably comprises a rectangular metal plate extending substantially parallel to the faceplate and having up-standing side portions extending along at least two opposite edges which bear at least in part against respective side wall portions of the envelope. The spacing structure may also have at least two flanges which engage at least in part both with respective side wall portions of the envelope in order to locate the spacing structure with respect to the envelope side wall and with respective up-standing portions of the metal plate to space the sub-assembly a predetermined distance from the faceplate. In this case, the up-standing side portions and flanges of the partition and the spacing structure respectively preferably are provided with respective locating means, for example fingers and cut-outs, which cooperate with each other to locate the partition, and thus the sub-assembly, with respect to spacing structure, and hence the faceplate, and prevent relative displacement between the partition and spacing structure laterally, i.e. in a plane parallel to the faceplate.

In addition to the rectangular metal plate, the partition may further include a glass plate secured to the metal plate and extending over its surface facing the faceplate, and opposite to that on which the means for producing an electron beam and deflection means are carried, and on which the electrodes of said deflection electrode arrangement are deposited.

BRIEF DESCRIPTION OF THE DRAWINGS

An embodiment of the invention will now be described, by way of example, with reference to the accompanying drawings in which.

DESCRIPTION OF THE PREFERRED EMBODIMENT

Figure 1:
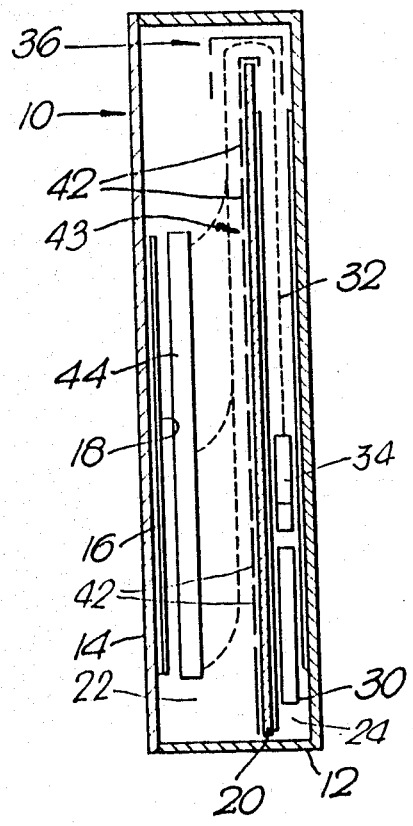
Fig. 1. (Prior Art)
FIG. 1 is a schematic cross-sectional view through the flat display tube.

Referring firstly to FIG. 1, the flat cathode ray display tube shown in generally similar to that described in British published Patent Application No. 2101396A corresponding to U.S. patent application Ser. No. 830,388, filed Feb. 14, 1986 (PHB32794). Accordingly, only a brief description of the tube and its operation will be given here and for a fuller description reference is invited to the aforementioned published application, details of which are incorporated herein by reference.

The flat display tube 10 comprises an envelope 12 including a planar glass faceplate 14 which carries on its internal surface a phosphor screen 16 including an electrically conductive backing electrode 18 constituting the screen acceleration electrode.

A partition 20 extending parallel to the faceplate 14 and for a major part of the hieght of the envelope 12 divides the interior of the envelope 12 to form a front portion 22 and a rear portion 24.

An electron gun 30 for producing an upwardly directed, low energy electron beam 32 is provided in the rear portion 24. An upwardly directed electrostatic line deflector 34 is spaced a short distance from the final anode of the electron gun 30 and arranged coaxial therewith. In operation, this deflector 34 deflects the electron beam in a plane parallel to the partition 20, and hence the faceplate 14, to effect line scanning.

At the upper end of the interior of the envelope there is provided a multi-component reversing lens 36 which extends above and is disposed symmetrically with respect to the upper edge of the partition 20. The reversing lens 36 operates to deflect the electron beam 32 coming from the line deflector 34 through 180° so that it then travels in the opposite direction and on the opposite side of the partition 20 whilst continuing along the same angular path from the line deflector 34.

On the front side of the partition 20, facing the faceplate 14, there are provided a plurality of laterally elongate, vertically spaced electrodes 42 overlying the screen 16 and constituting a deflection electrode arrangement 43. The electrodes 42 of the arrangement are selectively energised to provide frame deflection of the electron beam 32 onto the input side of a channel plate electron multiplier 44. The multiplier 44 extends parallel to and is spaced from both the deflection electrode arrangement 43 and the faceplate 14 and overlies the screen 16. Having undergone electron multiplication within the multiplier 44, the electron beam emanates from the output side of the multiplier, facing the screen 16, and is accelerated towards the screen by an accelerating field established by means of the electrode 18 to excite the screen and produce an image in raster scanning fashion.

The electron multiplier 44 may be a laminated dynode electron multiplier of the kind described in, for example, British Patent Specifications Nos. 1401969, 1434053 and 2023332A. However, in this particular embodiment the multiplier comprises a glass microchannel plate multiplier having a matrix of millions of channels of, say, 12 $\mu$m diameter and 15 $\mu$m pitch. The fabrication of glass matrix channel plate multipliers is generally well known and will not be described here in detail. For further information, in this respect, reference is invited to, for example, Acta Electronica Volume 14, No. 2, April 1971.

Figure 2:
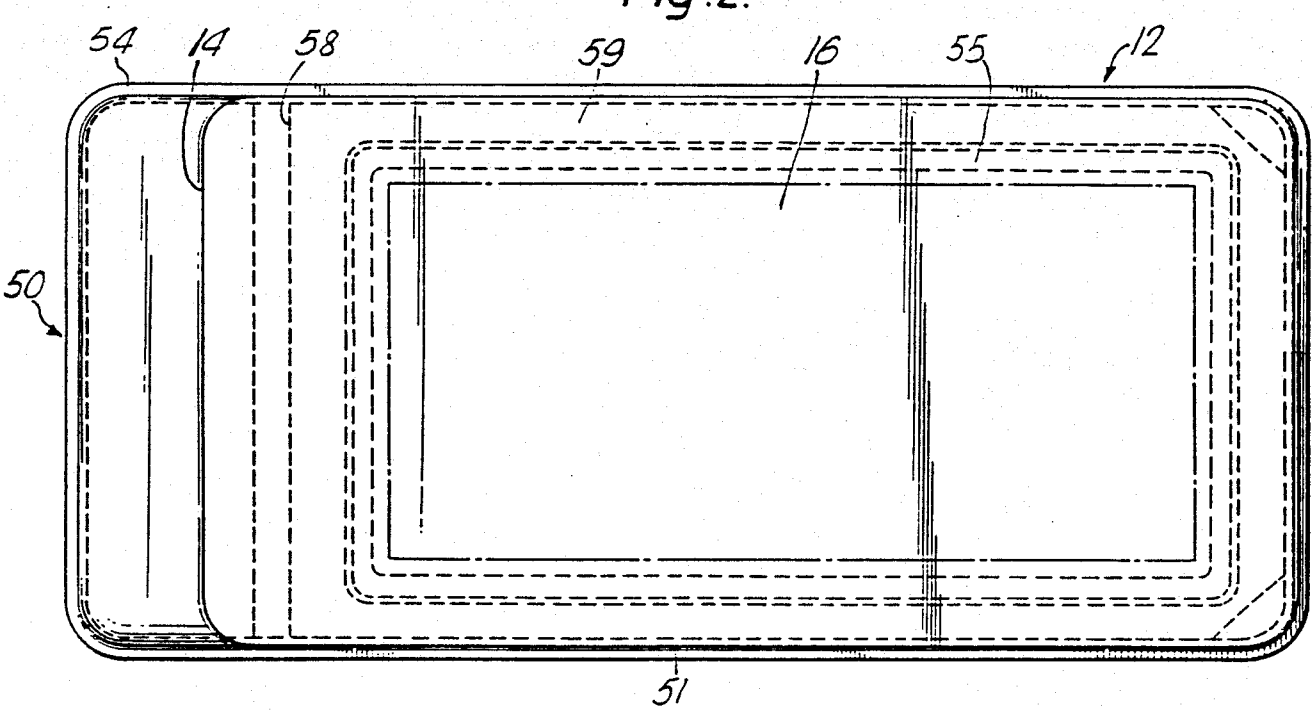
FIG. 2 is a plan view of the display tube showing in chain-dotted outline certain internal components of the tube.
Figure 3:
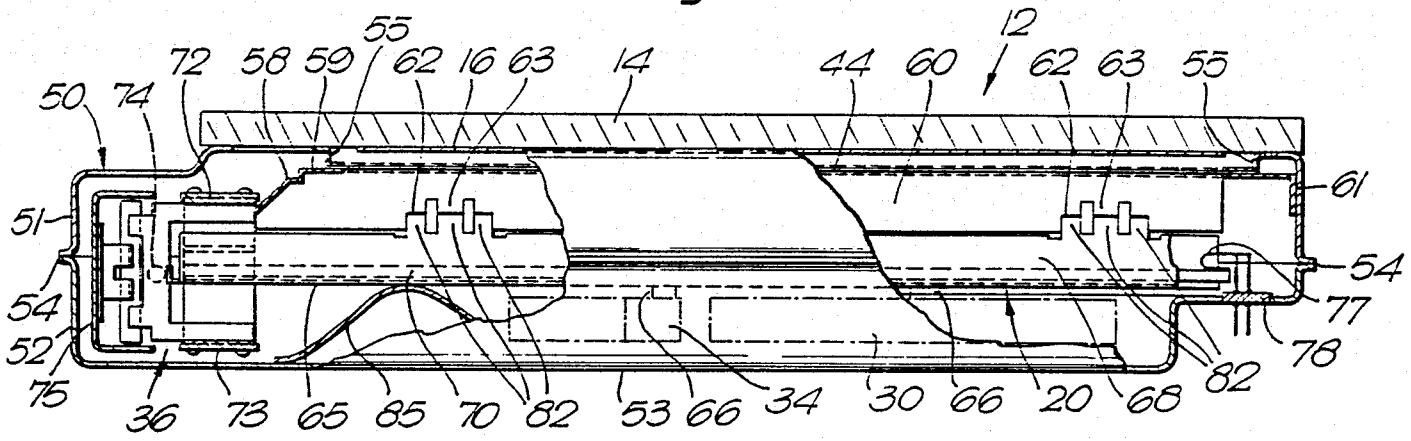
FIG. 3 is a side elevation of the tube partly in cross-section showing the structural inter-relationship between a sub-assembly and other internal components of the tube.
Figure 4:
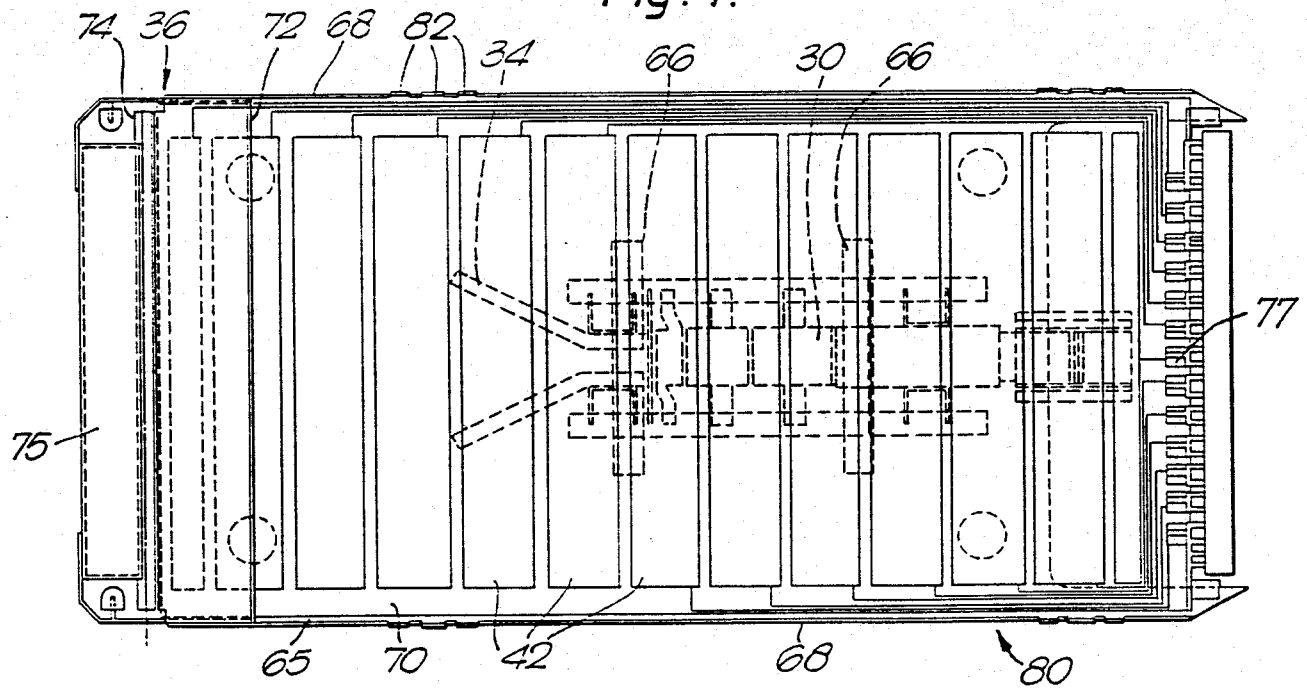
FIG. 4 is a plan view of the sub-assembly used in the tube.

FIGS. 2 to 4 show the construction of the tube in greater detail. Referring to FIGS. 2 and 3, the glass faceplate 14 is secured at its marginal portions in a vacuum-tight manner to a mild steel or metal alloy can 50. The can 50 is formed in two pieces, a first piece 51 defining part of the side walls of the envelope 12 and a second piece 52 defining the remainder of the side walls and, integrally therewith, a generally flat rear wall 53 of the envelope. The two pieces 51 and 52 of the can are welded together along abutting lips 54 thereof following installation of the internal components of the tube.

Extending around the border of the phosphor screen 16 with its backing electrode 18 on the faceplate 14, there is provided a rectangular, pressed metal, spacing frame member 55 comprising a continuous strip of "Z" shape cross-section. The outwardly-directed flange of the frame member 55 adjacent the faceplate 14 has a number of lugs (not shown) which project into corresponding recesses formed in the faceplate 14 in order to locate the frame member laterally on the faceplate 14. The inwardly-directed flange of the frame member 55 defines a rectangular opening and supports the electron multiplier 44 around its periphery such that it extends over this opening at a predetermined distance from, and parallel to, the screen 16. This inwardly-directed flange has a number of deformation in the form of pips which engage with the edges of the electron multipler 44 to locate the electron multiplier and prevent any lateral movement.

The electron multiplier 44 is urged against the frame member 55, and in turn the frame member 55 is urged against the faceplate 14, by a support member 58 extending the width of the envelope 12 and a mjor part of the length. The member 58 has a generally flat upper surface 59 which defines a rectangular opening corresponding to the opening in the frame member 55. The portion of the surface 59 surrounding the opening bears against the edge portion of the multiplier 44 and clamps it against the inwardly-directed flange of the frame member 55.

The suport member 58 has downwardly-extending side flanges 60 along its two longitudinal sides and a further side flange 61 at one end which abuts the side wall of the envelope 12 at one end of the envelope.

Each of the flanges 60 has two cut-outs 62 with a centrally-arranged tab 63 which is deformed outwardly and engages with an associated side wall of the envelope 12 to locate the member 58 with respect to the side walls. The four tabs 63 are spot welded to the side walls of the envelope piece 51 thereby fixing the components 44 and 55 in position and completing the assembly of the front portion of the tube prior to final assembly.

Referring now particularly to FIGS. 3 and 4, the electron gun 30 and the electrodes of the electrostatic line deflector 34 are mounted via suitable supports 66 on the lower flat surface of a generally rectangular metal plate 65 remote from the faceplate 14.

The plate 65, which extends the width of the envelope and for a major part of its length parallel to the faceplate, has upstanding side flanges 68 along its two longitudinal edges. Disposed between these flanges 68 over the upper flat surface of the plate 65, there is secured a rectangular glass plate 70 carrying the plurality of elongate electrodes 42 constituting the frame deflection electrode arrangement 43. The palte 65 and plate 70 together constitute the partition 20 shown in FIG. 1.

At one end of the plate 65 there is the reversing lens 36. The lens 36 comprises four operative components, all of which are mountd on the end of the plate. These components are in the form of a pair of U-shape metal members 72, 73 disposed in mirror opposition across the width of the plate 65 on opposite sides of the plate and overlying an end poriton of the plate, a metal rod 74 attached to the edge of the plate, and a channel section metal member 75 with end walls which is carried by arms including insulator parts for electrically isolating the member 75 from the plate 65 and which extend from the plate so as to support the member 75 away from the edge of the plate. In operation, the electron beam 32 from the deflector 34 travels between the plate 65 and the member 73, bends through the region intermediate the member 75 and the rod 74 and then travels over the other side of the plate between the plate and the member 72 before being deflected by the electrode 42 onto the screen 16 through the opening in parts 55 and 58.

At the other end of the plate 65, there is provided a termination arrangement 77 for the electrically operable components mounted on the plate. Power is supplied via a lead-through 78 in the rear wall of the envelope whose pins are connected to the termination arrangement.

The plate 65 together with the electron gun 30, line deflector 34, reversing lens 36 and glass plate 70 carrying the deflection electrode arrangement 43 constitute a sub-assembly of the tube, generally refereced 80. These components are assembled to form a single unit prior to final assembly of the tube, thus facilitating the correct positioning of the operative componets 30, 34 and 43 relative to one anther, with the plate 65 acting as a reference surface.

As previously mention the plate 65 has integrally formed side flanges 68 extending upwardly from its two longitudinal edges. These flanges 68 are spaced at substantially the same spacing as the side flanges 60 of the member 58. Each of these two side flanges 68 is provided with two sets of three prjecting fingers 82, the respective sets of fingers being spaced from one another by a distance corresponding to the spacing between the respective pairs of cut-outs 62 on the flanges 60 of the support member 58.

The sub-assembly 80 is positioned within the envelope 12 with the sets of fingers 82, as shown in FIG. 3, mating with respective ones of the cut-outs 62 to provide both horizontal and vertical registration. More precisely, the outer two fingers of each set engage in the respective outer portions of the cut outs 62 and the inner finger, which like the tab 63 of each cut-out 62 is bent outwardly, bears against the side wall of the envelope. In this way, the sub-assembly 80 is accurately positioned in predetermined spatial relationship to the faceplate 14, the frame member 55 and the support member 58 together constituting in this respect a spacing structure, and movement of the sub-assembly 80 in a plane parallel to the faceplate 14 prevented.

The sub-assembly 80 is maintained in this position by a plurality, in this case four, resilient bow springs 85 (only one of which is shown in FIG. 3) secured at their one end to the rear wall 53 of the envelope which, when the envelope pieces 51 and 52 are brought together upon final assembly of the tube, bear with their curved central regions against the lower surface of the plate 65 at appropriate spaced locations in the vicinity of the sets of fingers 82 and act to urge the sub-assembly 80 towards the spacing structure and the faceplate 14 to maintain inter-engagement between the sets of fingers 82 and the cut-outs 62. Some, or all, of the springs 85 may alternatively be mounted on the plate 65. Of course, the springs 85 are arranged in the envelope at suitable locations so as to maintain evenly-distributed pressure on the plate 65 whilst not interfering with the electron beam path. The resilient strips 85 remain flexed after welding together the two envelope pieces 51 and 52 so that the force acting on the sub-assembly 80 remains constant.

It will be appreciated therefore that the glass faceplate 14 acts as a reference surface with respect to which the major operative components of the tube are positioned by way of supporting structures either directly or indirectly abutting the faceplate.

As a result of using the sub-assembly 80, and forming the sub-assembly as a single unit, the relative positioning of the components thereof can be accurately determined and checking of those components to ensure satisfactory operational characteristics can be carried out readily prior to final assembly of the tube. Moreover, the positioning of the sub-assembly with respect to the faceplate 14 upon final assembly is achieved with a high degree of accuracy simply and conveniently by means of the spacing structure comprising the frame member 55 and the support member 58.

I claim:

1. A flat cathode ray tube comprising: an envelope including a faceplate on which a screen is provided; a partition comprising a glass plate within the envelope and arranged substantially parallel to, and spaced from, the faceplate, the partition dividing the envelope into a front portion adjoining the faceplate and a rear portion which communicates with the front portion at one end of the envelope; a channel plate electron multiplier arranged in the front portion substantially parallel to, and spaced from, both the faceplate and the partition, the electron mulitplier having an input side facing the partition and an output side facing the faceplate; means in the rear portion for producing an electron beam which is directed towards said one end; means in the rear portion for deflecting the electron beam in one dimension; a reversing lens at said one end for deflecting the electron beam into the front portion; and a deflection electrode arrangement carried by the partition and facing the electron multiplier for deflecting the electron beam in the front portion toward the screen;

characterized in that the partition futher includes a rectangular metal plate secured to the glass plate and extending substantially over its surface facing the rear portion of the envelope, and having upstanding side portions extending along at least two opposite edges which bear at least in part against respective sidewall portions of the envelope, and further characterized in that the means for producing the electron beam and the means for deflecting the electron beam in one dimension in the rear portion are mounted on the metal plate so as to form together with the glass plate and the deflection electrode arrangement carried thereby a subassembly, said subassembly being mounted within the envelope in a predetermined position with respect to the faceplate.

2. A flat cathode ray display tube according to claim 1, wherein the reversing lens is also mountd on the metal plate.

3. A flat cathode ray display tube according to claim 1, wherein the partition of the subassembly and the electron multiplier are maintained in predetermined spatial relationship with the faceplate by a spacing structure engaging between the faceplate and the multiplier and between the multiplier and the partition.

4. A flat cathode ray display tube according to claim 3, wherein the spacing structure and the faceplate are provided with cooperating element for locating the spacing structure laterally of the faceplate.

5. A flat cathode ray display tube according to claim 3, wherein the spacing structure extends around the screen and defines an opening overlying the screen, the multiplier and the deflection electrode arangement of the subassembly.

6. A flat cathode ray display tube according to claim 5, wherein the spacing structure includes at least two flanges each of which engage at least in part with respective sidewall portions of the envelope to locate the spacing structure with respect to the envelope sidewalls and with respective upstanding side portions of the metal plate to space the subassembly a predetermined distance from the faceplate.

7. A flat cathode ray display tube according to calim 6, wherein the upstanding side portions and the flanges of the partition and the spacing structure respectively are provided with respective locating means which cooperate with each other to locate the partition with respect to the spacing structure and prohibit relative displacement between the partition and spacing structure laterally.

8. A flat cathode ray display tube according to claim 7, wherein the respective locating means comprise inter-engaging fingers and cutouts on the flanges and upstanding side portions.

9. A flat cathode ray display tube according to claim 1 wherein the electrodes of the deflection electrode arrangement are deposited on the surface of the glass plate facing the faceplate.

10. A flat cathdoe ray display tube according to claim 3, wherein the partition is urged against the spacing structure by resilient means acting between a rear wall of the envelope and the partition.

* * * * *